US012139248B2

(12) United States Patent
Leblond

(10) Patent No.: US 12,139,248 B2
(45) Date of Patent: Nov. 12, 2024

(54) FABRIC AIR SHAFT VENTILATOR WITH INSTANT OPENING AND FASTENING FOR BOATS

(71) Applicant: Vincent Leblond, Saint Vivien de Blaye (FR)

(72) Inventor: Vincent Leblond, Saint Vivien de Blaye (FR)

( * ) Notice: Subject to any disclaimer, the term of this patent is extended or adjusted under 35 U.S.C. 154(b) by 468 days.

(21) Appl. No.: 17/669,967

(22) Filed: Feb. 11, 2022

(65) Prior Publication Data

US 2022/0258846 A1 Aug. 18, 2022

(30) Foreign Application Priority Data

Feb. 12, 2021 (FR) ..... FR2101379

(51) Int. Cl.
*B63J 2/10* (2006.01)

(52) U.S. Cl.
CPC ..... *B63J 2/10* (2013.01)

(58) Field of Classification Search
CPC ..... B63J 2/10
See application file for complete search history.

(56) References Cited

U.S. PATENT DOCUMENTS 4,050,363 A * 9/1977 Fuerst ..... B63J 2/02 285/292.1
4,434,740 A 3/1984 Childs
4,706,593 A 11/1987 Vail
5,588,386 A 12/1996 Schilt
6,289,834 B1 9/2001 Phillips

FOREIGN PATENT DOCUMENTS

DE 203 19 587 U1 3/2004

* cited by examiner

*Primary Examiner* — Stephen P Avila

(74) *Attorney, Agent, or Firm* — Greer, Burns & Crain, Ltd.

(57) ABSTRACT

Fabric air shaft ventilator with instant opening and fastening for boats.

The invention relates to a device for improving air circulation on board boats.

It consists of a frustoconical-shaped fabric (8) whose air inlet (1) is maintained in position by two rods (2) and (4) maintained in the form of loops in contact with the deck of the boat and whose air outlet (3) is positioned inside the deck hatch.

The device can be oriented in all directions and does not require anchoring at height, so that it can be used on all deck hatches of sailboats and motorboats.

The rod (1) is folded in a figure of eight so as to occupy less space when it is not in use.

The device according to the invention is particularly intended to improve comfort on board boats by improving air circulation.

9 Claims, 2 Drawing Sheets

FABRIC AIR SHAFT VENTILATOR WITH INSTANT OPENING AND FASTENING FOR BOATS

CROSS-REFERENCE TO RELATED APPLICATIONS

This patent application claims the benefit of priority to French patent application FR 2101379 filed Feb. 12, 2021, the entire disclosure of which is herein incorporate by reference.

TECHNICAL FIELD

The present invention relates to a device for amplifying the circulation of air in a boat and thus improving comfort on board.

BACKGROUND

Opening the horizontal deck hatches provides little or no air intake depending on the orientation of the hatch cover, and the additional textile air shafts take time to put in place and must be connected to a halyard in the upper part, which limits their use to the panels of the foredecks of sailboats.

SUMMARY

The present device adapts to all deck hatches of sailboats and motorboats. According to a first feature, it comprises a fabric of frustoconical shape whose orifices are connected to rods maintained in the form of a loop.

A large diameter rod corresponding to the air inlet is connected to two rods maintained in loops located in a horizontal plane in contact with the deck of the boat.

The air inlet is maintained in a position perpendicular to the direction of the wind owing to two ropes taken from the horizontal rod upstream and to the air outlet rod of the frustoconical fabric compressed to cross the deck hatch before being released inside the boat, a spring-loaded clamp helping keep the assembly in position on the deck. According to particular embodiments:

- the air inlet orifice has a diameter approximately twice as large as the diameter of the air outlet orifice in order to be folded into a figure of eight for a reduced size when not in use.
- a connecting casing keeps the two rods in contact with the deck in the same plane and comprises a hinge to allow folding.
- the connecting casing allows free rotation of the rod of the air inlet orifice.
- the ends of the rods in contact with the deck are held at 90 degrees in the connecting casing.
- a horizontal rope allows the air inlet rod to be deformed along a vertical axis in order to better capture the wind and to encumber the deck less.

BRIEF DESCRIPTION OF THE DRAWINGS

The accompanying drawings illustrate the invention.

DETAILED DESCRIPTION

Figure 1:
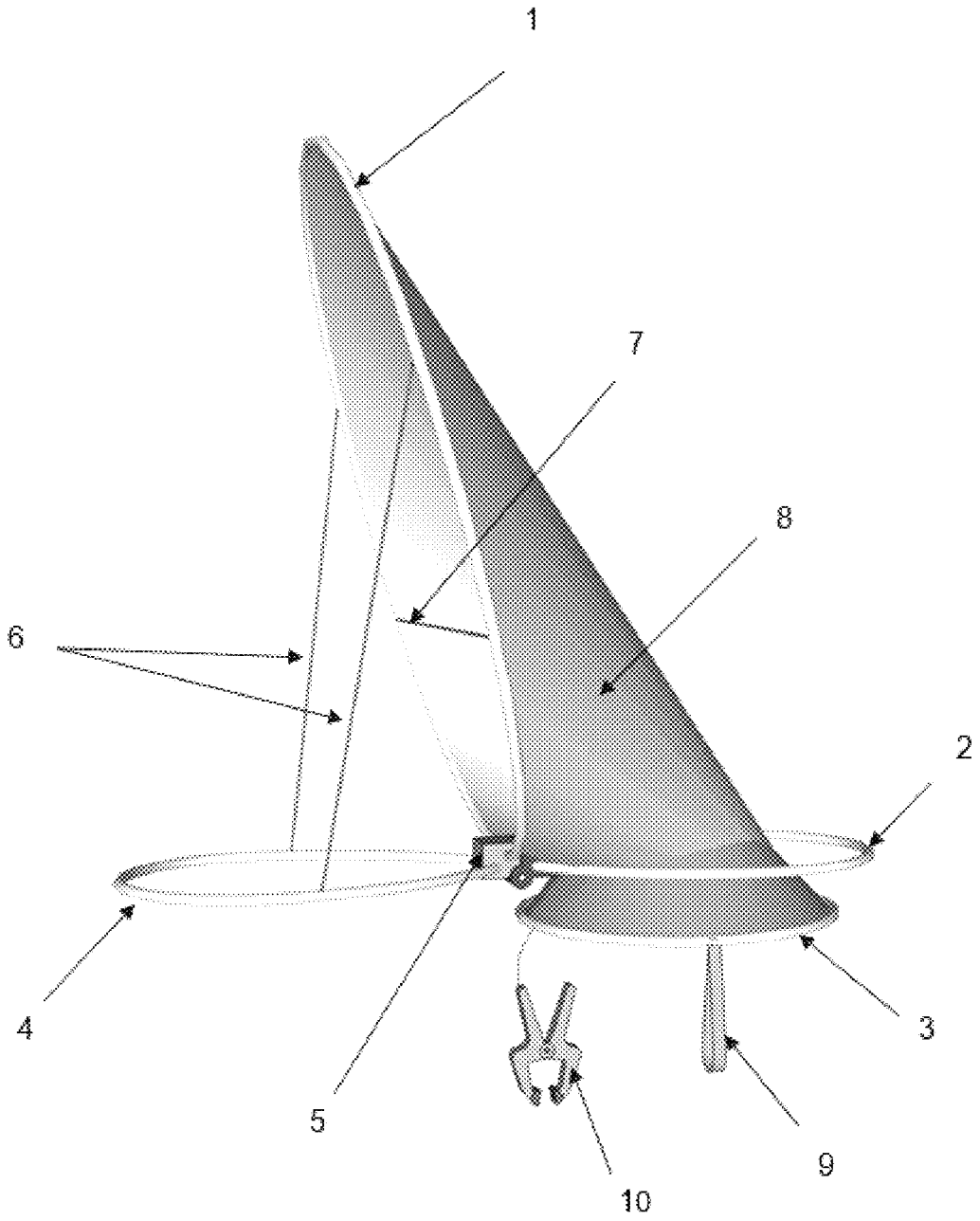
FIG. 1 shows, in perspective, the device of the invention.

With reference to these drawings, the device comprises a fabric of frustoconical shape (8) whose air inlet orifice is connected to a rod (1) maintained in the form of a loop and whose outlet orifice is connected to a rod (3) maintained in the form of a loop.

The large-diameter rod (1) is connected to two rods (4) and (2) maintained in the form of loops via a casing (5). This rod (1) is free to rotate in the casing, which receives a second rod (2) maintained in the form of a loop downstream, above the open deck hatch.

The ends of the rods (4) and (2) are held at 90 degrees in the casing (5) in order to ensure rigidity of the figure of eight formed by the loops (2) and (4). The casing (5) also ensures that these loops are maintained in the same horizontal plane and a spring-loaded clamp (10) reinforces the maintenance of the assembly on the deck (11).

Figure 2:
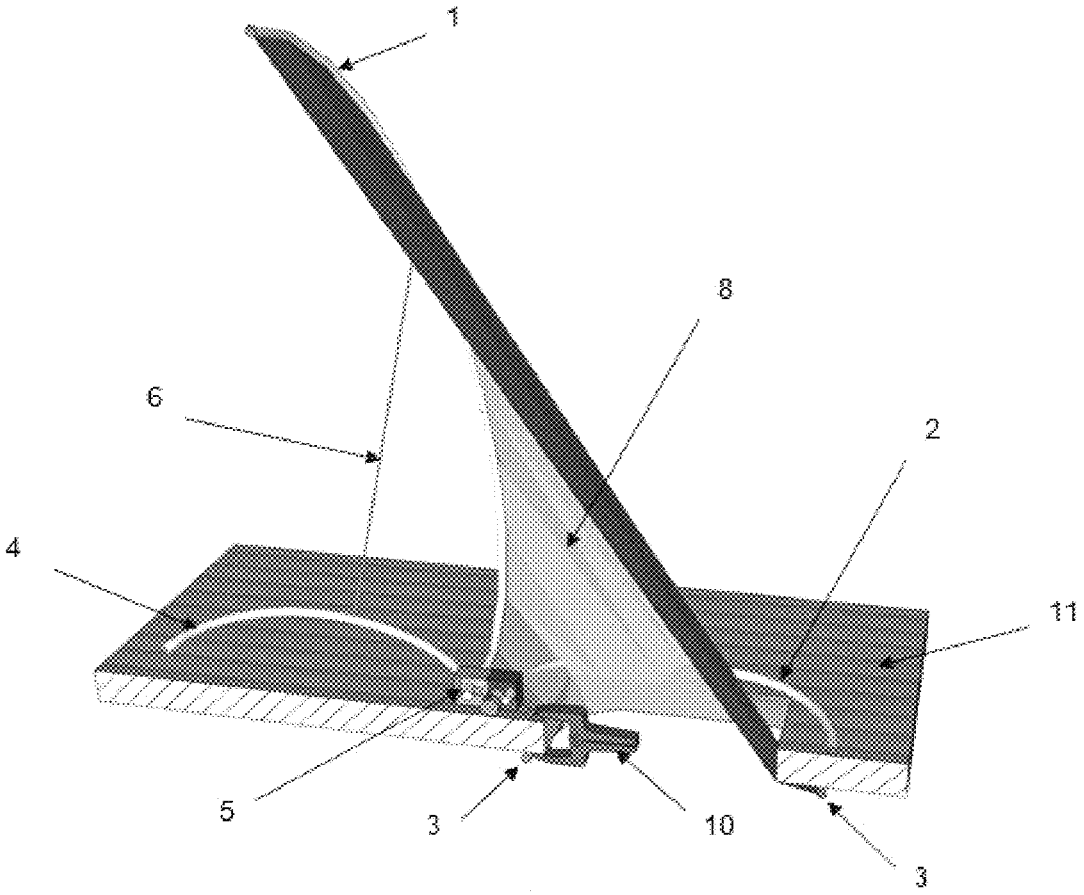
FIG. 2 shows, in section, the device deployed on the deck of the boat.

The rod (1) is maintained in a position perpendicular to the direction of the wind owing to two upstream ropes (6) taken from the rod (4) and to the downstream air outlet rod (3) compressed to cross the deck (11) before being released inside the boat as shown in FIG. 2.

The appearance of the wind causes the rod (1) to tilt slightly downstream and the rod (4) to take off from the deck (11). When the wind stops, the rod (4) will be brought back into contact with the deck (11) owing to its flexibility.

A rope (7) stretched in a horizontal plane through the rod (1) allows its deformation in the vertical plane in order to better capture the wind and to clutter the deck less.

Figure 3:
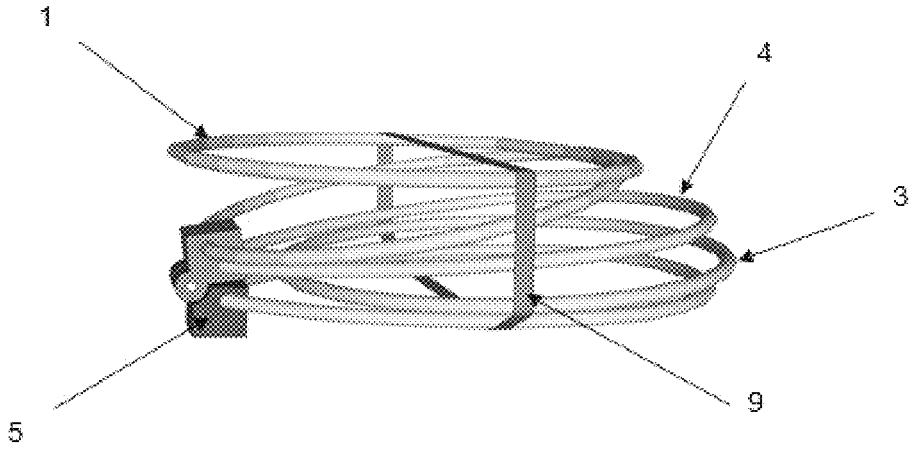
FIG. 3 shows the device folded up when not in use, without the frustoconical-shaped fabric.

The folded device is shown in FIG. 3. The rod (1) formed into a figure of eight and the rods (2) and (4) are folded back on themselves and brought together owing to the articulated casing (5). These overlapping loops are held by an elastic strap (9).

By way of non-limiting example, the loop (1) has a diameter of 100 cm, the loops (2), (3) and (4) of 50 cm. The rod for the loop (1) has a diameter of 4 mm for easy folding into a figure of eight. The rods for the loops (2) and (4) have a diameter of 5 mm for increased rigidity and greater restoring force. The rod for the loop (3) has a diameter of 4 mm. The rods used may be fiberglass or carbon.

The device according to the invention is particularly intended to amplify the circulation of air on board boats.

I claim:

1. A device for amplifying the circulation of air on board boats, characterized in that it comprises a fabric of frustoconical shape (8) whose large-diameter air inlet orifice (1) consists of a retaining rod maintained in the form of a loop connected to two rods (2) and (4) maintained in the form of loops in the same plane in contact with the deck of the boat (11) and the air outlet orifice (3) consists of a rod maintained in the form of a loop introduced through the deck hatch before being released inside the boat.

2. The device according to claim 1, characterized in that the air inlet orifice (1) is connected to the loop (4) by two ropes (6).

3. The device according to claim 1, characterized in that the connecting casing (5) is articulated and allows the loops (4) and (2) to be positioned in the same plane or to be folded back on themselves.

4. The device according to claim 3, characterized in that the articulated connecting casing (5) allows the rotation of the air inlet rod (1).

5. The device according to claim 3, characterized in that the articulated connecting casing (5) maintains the ends of the rods (4) and (2) orthogonal.

6. The device according to claim 1, characterized in that the air inlet loop (1) has a diameter approximately twice as large as the air outlet loop (3).

7. The device according to claim 1, characterized in that a rope (7) is stretched in a horizontal plane through the rod (1).

8. The device according to claim 1, characterized in that a spring-loaded clamp (10) keeps the assembly in contact with the deck.

9. The device according to claim 1, characterized in that an elastic strap (9) keeps the device folded.

* * * * *